United States Patent [19]

Kitagaki et al.

[11] Patent Number: 4,792,662

[45] Date of Patent: Dec. 20, 1988

[54] SHEET ELECTRICAL HEATING ELEMENT

[75] Inventors: Hiroshi Kitagaki, Kusatsu; Seiichi Takagawa; Katuma Shinagawa, both of Settsu, all of Japan

[73] Assignee: Daikin Industries, Ltd., Osaka, Japan

[21] Appl. No.: 29,967

[22] Filed: Mar. 25, 1987

[30] Foreign Application Priority Data

Sep. 2, 1986 [JP] Japan ..... 61-135357[U]

[51] Int. Cl.[4] ..... H05B 3/34

[52] U.S. Cl. ..... 219/545; 219/547; 219/548; 219/549

[58] Field of Search ..... 219/545, 544, 546, 547, 219/548, 549

[56] References Cited

U.S. PATENT DOCUMENTS 3,946,194 3/1976 de la Bretoniéve ..... 219/545 X
4,538,054 8/1985 de la Bretoniéve ..... 219/545 X

FOREIGN PATENT DOCUMENTS 5976 4/1962 Japan .
158516 1/1965 Japan .
3334 1/1965 Japan .
16954 4/1981 Japan .
154589 10/1983 Japan .
4188 1/1986 Japan .

*Primary Examiner*—Elliot Goldberg
*Assistant Examiner*—Marvin M. Lateef
*Attorney, Agent, or Firm*—Birch, Stewart, Kolasch & Birch

[57] ABSTRACT

A sheet electrical heating element comprising warp yarns which are constituted of a plurality of warp electrically conductive yarns disposed at predetermined intervals and a plurality of warp electrically non-conductive yarns, one or more of which are arranged in each of said intervals of the warp electrically conductive yarns; and weft yarns which are constituted of a plurality of adjacent weft electrically non-conductive yarns and a weft woven electrode of predetermined length in the warp direction. The woven electrode is constituted of weft electrically conductive yarns forming fancy twill weave together with the warp yarns so that the texture may be loose and flexible. The weft electrically conductive yarns are constituted of a core yarn, an inner strip of copper foil which is spirally coiled around the core yarn in one direction, and an outer strip of copper foil which is coiled on the inner copper foil so as to cross the inner copper foil so that great folding endurance may be obtained and that the woven electrode may have great capacity of the electric current.

7 Claims, 3 Drawing Sheets

SHEET ELECTRICAL HEATING ELEMENT

BACKGROUND OF THE INVENTION

The present invention relates to a sheet electrical heating element and more particularly to the structure of woven electrodes of the sheet electrical heating element which are formed by electrically conductive yarns interlaced in the sheet electrical heating element.

In a conventional sheet electrical heating element, there is an electrode of a construction that electrically conductive wires provided at specific intervals among warp yarns in the part of the electrode of the fabric woven through a combination weave face each other in the direction of thickness of the fabric and that further electrically conductive wires provided in parallel with weft yarns are interlaced with said wires so as to combine each of them in the direction of thickness of the fabric, as disclosed in the Japanese Patent Publication No. 16954/1981.

This type of structure of woven electrodes has been considered as effective in increasing the capacity of the electrode.

However, according to this type of structure of woven electrodes, the electrode portion is thick due to the combination weave and, therefore, the sheet electrical heating element with this electrode lacks flexibility and is doubled or folded with difficulty.

Moreover, since the textile weave of the electrode of said prior art heating element is a plain weave which makes the fabric very close and firm, the heating element has the disadvantage that it lacks flexibility, and therefore, feels hard.

In addition to the lack of flexibility, the conventional electrodes easily break because the electrically conductive wires used for the electrode are made of yarns with a single layer of copper foil or tinned twisted gold wire. Accordingly, the heating element provided with this kind of electrode has a weak folding endurance as a whole, and is not suitable for carpets and similar floor coverings which are often folded and moved from place to place.

SUMMARY OF THE INVENTION

The present invention has been realized in order to improve the prior art electrode, in the light of the situation that the conventional heating element lacks flexibility and has a weak endurance to bending at the portion of the electrode, as described above.

An object of the present invention is to give flexibility to woven electrodes by making the textile weave, at the electrodes a fancy twill weave, and at the same time, strengthening the folding endurance of the woven electrodes. Thus the woven electrodes are given flexibility by the fancy twill weave, while realizing a long-term stable supply of electricity, regardless of bending or folding of the sheet electrical heating element, by adopting as the electrode, electrically conductive yarns, each of which comprises a core yarn, a strip of copper foil which is coiled spirally around the core yarn in one direction, and another strip of copper foil which is coiled to cross the former strip of copper foil.

The sheet electrical heating element of the present invention is characterized in that it comprises warp yarns which are constituted of a plurality of warp electrically conductive yarns disposed at predetermined intervals and a plurality of warp electrically non-conductive yarns, one or more of which are arranged in each of said intervals of the warp electrically conductive yarns; and weft yarns which are constituted of a plurality of adjacent weft electrically non-conductive yarns and a weft woven electrode of predetermined length in the warp direction, the weft woven electrode being constituted of weft electrically conductive yarns forming a fancy twill weave together with the warp yarns, the weft electrically conductive yarns being constituted of a core yarn, an inner strip of copper foil which is spirrally coiled around the core yarn in one direction, and an outer strip of copper foil which is coiled on the inner strip of copper foil so as to cross the inner strip of copper foil.

Floats of the warp and weft yarns at the electrode become longer because of the fancy twill weave and the surface and undersurface of the electrode become even and smooth. In addition, the textile weave at the electrode becomes loose and flexible.

Furthermore, as each of the weft electrically conductive yarns of the electrode comprises copper foil which is spirally double-coiled around the core yarn with outer turns of copper foil crossing inner turns thereof, the folding endurance and the capacity of the electric current is double compared with a yarn with a copper foil which is single-coiled around the core yarn. As a result, it is possible to narrow the width of the woven electrode and make the electrode portion flexible.

Consequently, the woven electrode increases in flexibility and folding endurance as a whole.

BRIEF DESCRIPTION OF THE DRAWINGS

The object and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
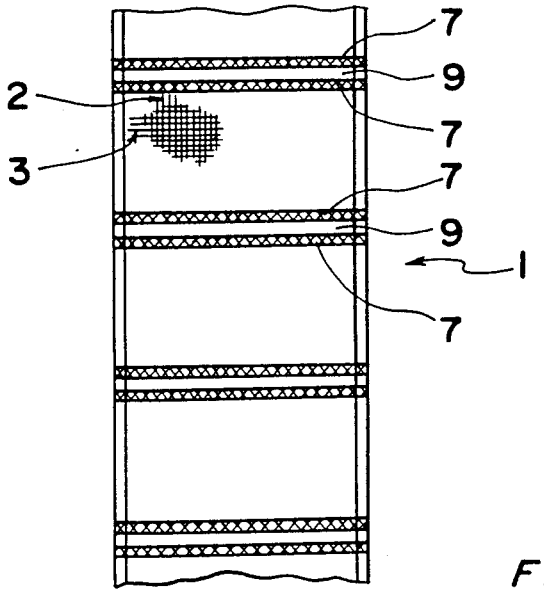
FIG. 1 is a schematic plan view of a sheet of electrical heating element according to an embodiment of the present invention.

Before the description of the present invention proceeds, it is to be noted that like parts are designated by like reference numerals throughout the accompanying drawings.

Referring now to FIG. 1 which shows a schematic view of a sheet electrical heating element of an embodiment of the present invention, the sheet electrical heating element 1 is comprised of warp yarns 2 and weft yarns 3 in the form of a fabric.

In the sheet electrical heating element 1, the weft 3 (See FIG. 6) consists of a plurality of electrically non-conductive polyethylene fibrous yarns 6 of 4.5 mm in width and 22 μm in thickness, which are adjacent to each other, and weft electrically conductive yarns 8 which constitute each of the woven electrodes 7 in the sheet electrical heating element 1. The portion with crossed oblique lines in FIG. 1 indicates a woven electrode 7 which is incorporated in the fabric as a part of the weft yarns 3. A plurality of pairs of woven electrodes 7 are provided repeatedly with a pitch of 810 mm, for example, in the sheet electrical heating element 1 of 1610 mm in width. Each of the woven electrodes 7 is about 10 mm long in the warp direction and each pair of electrodes 7 have therebetween a cutting portion 9 of 35 mm in length in the warp direction.

Figure 2:
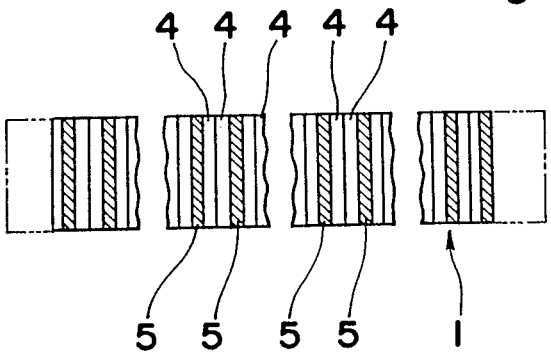
FIG. 2 is a partially cutaway plan view showing the construction of warp yarns according to the embodiment of the present invention.

As shown in FIG. 2, the warp consists of a plurality of warp electrically conductive resinous yarns 5 which are made from composite material of polytetrafuoroethylene resin and electrically conductive carbon, each resinous yarn being a 130 μm thick and 2 mm wide tape, and a plurality of electrically non-conductive polyethylene fibrous yarns 4 of 4.5 mm in width and 22 μm in thickness, two of which are provided in each interval between the electrically conductive resinous yarns 5. The electrically conductive yarns 5 are disposed at intervals of 5 mm in which double polyethylene fibrous yarns 4 are interlaced therebetween. The warp electrically conductive yarns 5 constitute a heat generation portion of the sheet electrical heating element 1.

Figure 3:
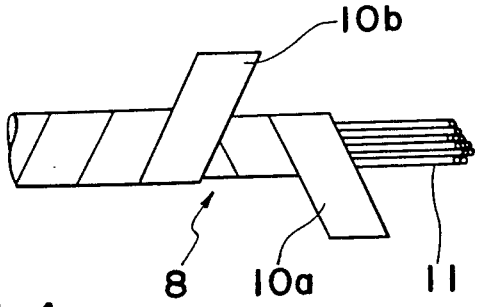
FIG. 3 is an enlarged view of an electrically conductive yarn of the woven electrode.

The weft electrically conductive yarns 8 of the woven electrodes 7 are of the following construction. As shown in FIG. 3, a bundle of 48 ends of polyester yarn (though only a part of them is illustrated) of 200 to 250 denier constitutes a core yarn 11, around which an inner strip of copper foil 10*a* of 320 μm in width and 27 μm in thickness is spirally coiled in one direction with a pitch of about 20 turns per 1 cm and an outer strip of copper foil 10*b*, which is same size as the strip of copper foil 10*a*, is coiled crosswise around the copper foil 10*a*.

As described above, since the wefr electrically conductive yarns 8 have the core yarn 11 therein which consists of a plurality of polyester yarns of a very small diameter, the weft conductive yarns 8 have sufficient tensile strength and at the same time has much flexibility. Furthermore, the electrically conductive yarns 8 have all their outer surface covered with an electrically conductive surface of thin strips of copper foil 10*a*, 10*b* spirally coiled crosswise with flexibility adaptive to bending, so that the same have a large contact area with the electrically conductive yarns 5 of the warp. The total area for the electric current to run can be also large because of the double structure. As a result, the structure of the electrically conductive yarns 8 are suitable as woven electrodes 7 having small contact resistance and also a great capacity.

Figure 4:
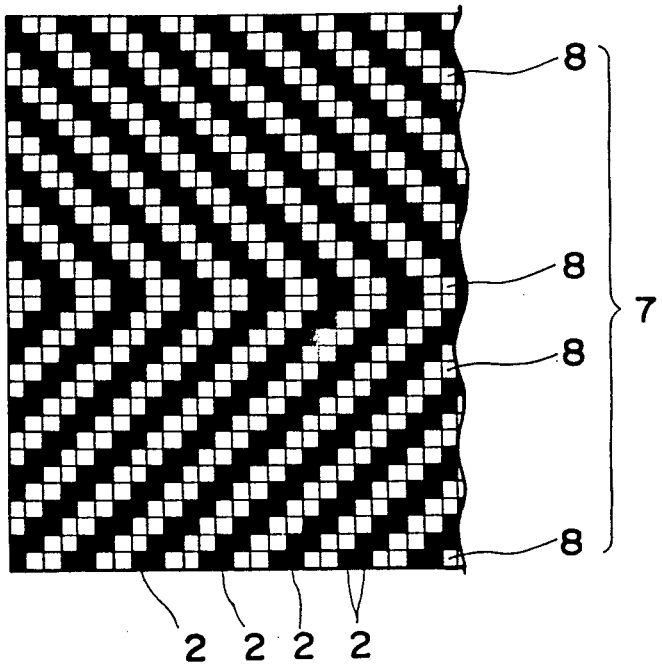
FIG. 4 is a schematic view showing the textile weave of the woven electrode.
Figure 6:
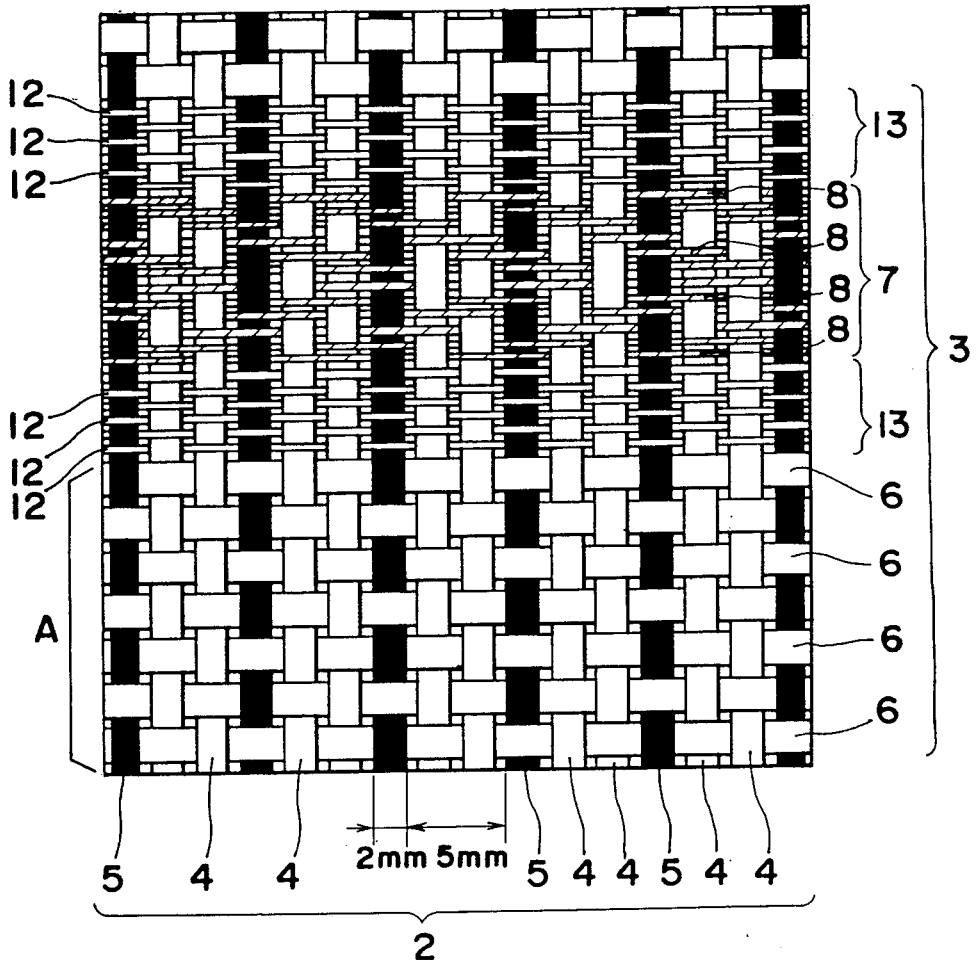
FIG. 6 is a front view illustrating the sheet electrical heating element of the modified example in detail.

In the sheet electrical heating element 1 consisting of the warp yarns 2 and the weft yarns 3, the portion except for the woven electrodes 7 is woven plain as shown in the area designated A in FIG. 6, while part of the electrodes 8 is woven by fancy twill weave. Of fancy twill weaves, herringbone twill weave is adopted in this embodiment, that is, each weft yarn goes alternately over and under the warp yarns by two across the width of the fabric though the pattern of interlacing of the warp and the weft is shifted by one warp in the weft direction so that the floats of the weft yarns may make diagonal lines. The direction of shifting of the interlacing is reversed with a predetermined pitch so that the diagonal lines may make a herringbone pattern, as understood from the schematic textile weave view shown in FIG. 4.

Naturally, floats of the warp yarns 2 and the weft yarns 3 become longer with such weave compared with the plain weave, so that the texture at the electrodes can be loose.

Cutting of the sheet electrical heating element 1 at the cutting portions 9 shown in FIG. 1 produces a plurality of quadrangular woven sheet electrical heating elements each of which has a pair of electrodes incorporated at the facing ends on the cutting side.

Since the warp electrically conductive yarns 5 serving as a heat generator are interlaced and kept in reliable contact with the weft electrically conductive yarns 8 serving as an electrode face to face, contact resistance is small enough to prevent abnormal heat generation. And, since the warp electricallyconductive yarns 5 are arranged uniformly all over the fabric, the heating element 1 can have uniform temperature distribution and stable performance.

Figure 5:
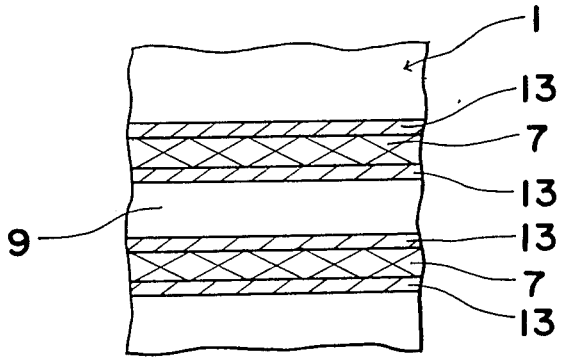
FIG. 5 is a schematic plan view showing a sheet electrical heating element according to a modified example of the present invention.

Referring now to FIG. 5 which shows a schematic view of a modified example of the above-described embodiment, a plurality of electrically non-conductive fibrous yarns, e.g. spun rayon yarns, are interwoven plainly in the fabric to form a pair of bands 13,13 adjacent the electrode 7 on the upper and lower sides thereof.

FIG. 6 is a front view illustrating in detail the sheet electrical heating element according to said modified example of the invention. In this figure, reference numerals 4 and 5 designate the polyethylene fibrous yarns and the electrically conductive yarns, respectively, both of which constitute the warp. Reference numeral 6 designates the polyethylene fibrous yarns forming a part of the weft. Reference numeral 8 designates the weft electrically conductive yarns forming the woven electrode 7, and reference numeral 13 designates the band of the electrically spun rayon yarns 12.

The above arrangement of the bands of spun rayon yarns corrects defects specific to the polyethylene fibrous yarns that the coefficient of sliding friction thereof is small and the electrically conductive yarns 8 easily slide thereon because of the smooth surface of the polyethylene fibrous yarns, and that they are easily expanded with a small pulling force because of their great elasticity. Accordingly, slipping off or snaky deformation of the woven electrode 7 prior to the final fitting treatment process can be prevented.

As in obvious from the above description, in the sheet electrical heating element of the present invention, the surface thereof is soft and smooth because the weave of the fabric at the electrode is fancy twill. Generally, the fancy twill weaves make the texture loose and flexible, and as a result, increase the folding endurance of the fabric. Furthermore, the electrically conductive yarn of the woven electrode is comprised of the copper foil which is double-coiled around the core yarn, so that both superficial and cross-sectional electrically conductive areas of the electrically conductive yarns are large and consequently, capacity of the electric current of the electrode is great. Therefore, the woven electrode can be made narrower in the warp direction with sufficient capacity of current. This also means that the number of the weft electrically conductive yarns, in other words, the number of times of picking at the electrodes in the weaving process is reduced to almost half. So, if the picking is performed at constant speed, the time required for weaving an electrode is reduced. Therefore, the time required for completing a sheet electrical heating element is reduced and its productivity is improved.

And also, since copper foil is spirally coiled, good flexibility against bending and great folding endurance can be obtained. Therefore, the woven electrode has a strong endurance to bending as a whole and maintains a stable performance of electric conduction for a long period of time.

A yarn formed by coiling a strip of copper foil spirally around a core yarn only in one direction is subject to curl by the influence of the spiral coiling direction, and disadvantageously, this causes a woven sheet to curl. On the other hand, as the weft electrically conductive yarn according to the present invention is formed by coiling the inner strip of copper foil spirally around the core yarn in one direction and then coiling the outer strip of copper foil on the inner strip of copper foil so as to cross the inner strip of copper foil, the influence of the spiral coiling direction is canceled by the counterbalance of the opposite directions of the strips of copper foil. Accordingly, curl of the sheet can be prevented.

Additionally, if a pair of electrically non-conductive bands consisting of a plurality of electrically non-conductive yarns are arranged so as to contain the woven electrode therebetween as described above, slipping off of the woven electrode caused by the small coefficient of sliding friction of the polyethylene fibrous yarns as well as the deformation of the woven electrode caused by the elasticity of the polyethylene fibrous yarn can be prevented.

Although the present invention has been described in connection with preferred embodiments thereof, many variations and modifications will now become apparent to those skilled in the art. It is preferred, therefore, that the present invention is limited not by the specific disclosure herein, but only by the appended claim.

What is claimed is:

1. A sheet electrical heating element comprising:

warp yarns which are constituted of a plurality of warp electrically conductive yarns disposed at predetermined intervals and a plurality of warp electrically non-conductive yarns, at least one of which is disposed in each of said intervals between the warp electrically conductive yarns; and weft yarns which are constituted of a plurality of adjacent weft electrically non-conductive yarns and a weft woven electrode having a predetermined length in the warp direction, the weft woven electrode being constituted of weft electrically conductive yarns forming a fancy twill weave together with the warp yarns, said weft electrically conductive yarns being constituted of a core yarn, an inner strip of copper foil which is spirally coiled around the core yarn in one direction, and an outer strip of copper foil which is spirally coiled on the inner strip of copper foil in the opposite directions so as to cross strip o copper foil in the opposite direction so as to cross the inner strip of copper foil.

2. The sheet electrical heating element as claimed in claim 1, wherein an electrically non-conductive band comprising a plurality of adjacent electrically non-conductive fibrous yarns which are interwoven in parallel with each other is formed adjacent to and in parallel with woven electrode on each lengthwise side of the woven electrode.

3. The sheet electrical heating element of claim 1, wherein the adjacent weft electrically non-conductive yarns are polyethylene fibrous yarns.

4. The sheet electrical heating element of claim 1, wherein warp electrically conductive yarns comprise a composite material of polytetrafluoroethylene resin and electrically conductive carbon.

5. The sheet electrical heating element of claim 4, wherein warp electrically non-conductive yarns is polyethylene.

6. The sheet electrical heating element of claim 1, wherein the core yarn is a bundle of polyester yarn.

7. The sheet electrical heating element of claim 6, wherein the core yarn has a denier of 200–250.

* * * * *